United States Patent [19]

Tran

[11] 4,345,210

[45] Aug. 17, 1982

[54] MICROWAVE RESONANT SYSTEM WITH DUAL RESONANT FREQUENCY AND A CYCLOTRON FITTED WITH SUCH A SYSTEM

[75] Inventor: Duc T. Tran, Buc, France

[73] Assignee: C.G.R. MeV, Buc, France

[21] Appl. No.: 153,853

[22] Filed: May 28, 1980

[30] Foreign Application Priority Data

May 31, 1979 [FR] France ..... 79 13986

[51] Int. Cl.[3] ..... H05H 7/00; H05H 13/00

[52] U.S. Cl. ..... 328/234

[58] Field of Search ..... 328/234; 313/62

[56] References Cited

U.S. PATENT DOCUMENTS

| | | | |
|---|---|---|---|
| 2,615,129 | 10/1952 | McMillan | 328/234 |
| 2,659,000 | 11/1953 | Salisbury | 328/234 |
| 2,789,222 | 4/1957 | Martin et al. | 328/234 |
| 3,426,231 | 2/1969 | Schnuriger | 328/234 |

FOREIGN PATENT DOCUMENTS

| | | | |
|---|---|---|---|
| 1614099 | 6/1970 | Fed. Rep. of Germany | 328/234 |

*Primary Examiner*—Bruce C. Anderson

*Attorney, Agent, or Firm*—Oblon, Fisher, Spivak, McClelland & Maier

[57] ABSTRACT

The invention discloses a resonant system for accelerating charged particles of the cyclotron type allowing this cyclotron to operate successively at two resonant frequencies $f_1$ and $f_2=mf_1$ ($m=2$ for example) without modification of the structure, this resonant system comprising a sealed enclosure connected to ground and in which is disposed at least one hollow electrode or "Dee" having the shape of a sector, the enclosure and the "Dee" being associated with a resonant element formed from a tubular external conductor closed at one of its ends by a metal plate and whose other end opens into the enclosure and, placed inside this external conductor, two internal conductors connected together, at one of their ends, by means of a connecting element determining with the external conductor a capacity C variable in value, for adjusting the operating frequencies $f_1$ and $f_2$ of the cyclotron and more particularly the ratio $f_1/f_2$.

11 Claims, 18 Drawing Figures

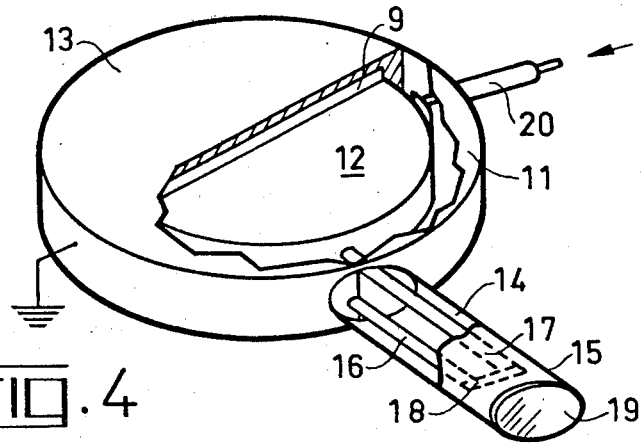
FIG. 4
FIG. 5
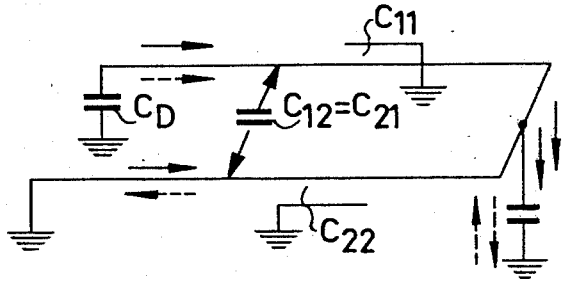
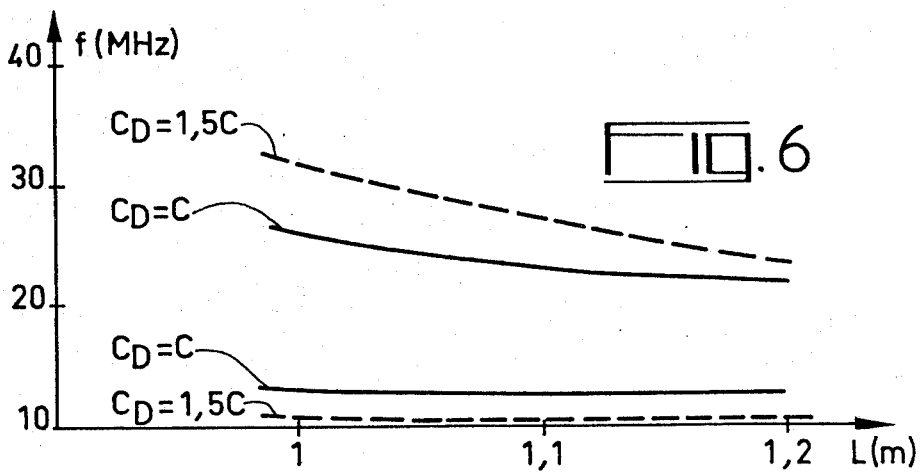
FIG. 6

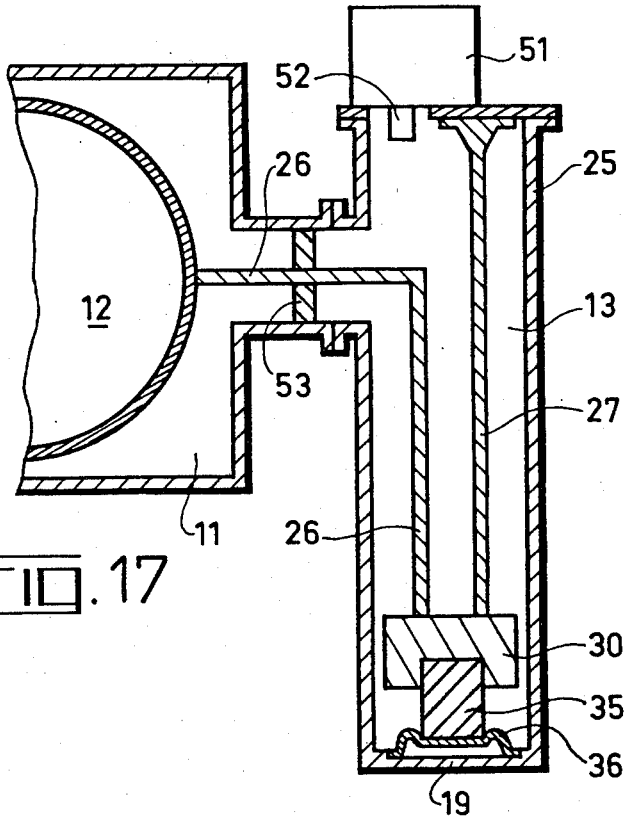
FIG. 17
FIG. 18
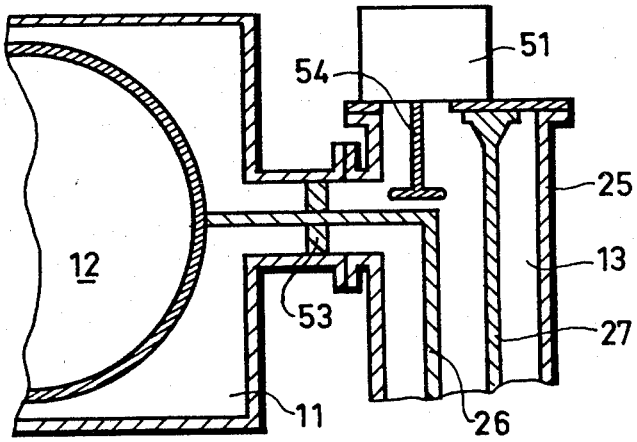

MICROWAVE RESONANT SYSTEM WITH DUAL RESONANT FREQUENCY AND A CYCLOTRON FITTED WITH SUCH A SYSTEM

BACKGROUND OF THE INVENTION

The present invention relates to a microwave resonant system having at least two resonant frequencies, such a resonant system being particularly provided for equipping a cyclotron intended for operation with two types of charged particles (deutons and protons for example).

In a cyclotron, the frequency of rotation of a particle of mass m and charge q is related to the magnetic induction B by the relationship:

$$f_o=2\pi(m/q\cdot B) \quad (1)$$

The frequency f of the accelerating microwave electric field must be equal to the frequency $f_o$ or to a multiple of this frequency $f_o$, i.e.:

$$f=k f_o \quad (2)$$

k being a whole number.

For a suitably chosen accelerating structure of the cyclotron, protons of mass m and deutons of mass 2m may be successively accelerated by means of an accelerating electric field of frequency f. In this case, the protons will be accelerated in the accelerating space (or spaces) at each period of the microwave electric field for example (k=1), whereas the deutons will only be accelerated every two periods of the accelerating electric field (k=2). Such a cyclotron does not need the value of the magnetic induction B to be changed, depending on the type of particles chosen, but the accelerating system must be able to operate in these two modes.

Furthermore, if the cyclotron is provided with an accelerating structure comprising a single semi-circular "Dee", the condition required for the particles to find at the level of the second interaction space an accelerating electric field, is that the time for these particles to travel a full revolution must be equal to an uneven number of half-periods of the frequency of the microwave signal injected into the accelerating structure (i.e. k=1 and k=3). The value of the magnetic induction will be determined as a consequence thereof. In this case the operation of the cyclotron will not be optimum for the two types of particles.

The resonant system of the present invention, which may operate on two resonant frequencies, enables a cyclotron to be constructed for successively accelerating two types of particles without modifying the magnetic induction.

SUMMARY OF THE INVENTION

According to the invention, a microwave resonant system for a cyclotron intended to operate at least at two frequencies $f_1$, $f_2$ and to accelerate successively charged particles of different types comprises: an enclosure connected to ground and at least one hollow electrode, a hollow electrode or sector-shaped "Dee" inside which the beam of particles to be accelerated may travel, said electrode being disposed in the enclosure without electrical contact with said enclosure, said enclosure being placed between the pole pieces of an electromagnet supplying a magnetic field required for operation of the cyclotron; the electrode or "Dee" delimiting with the enclosure interaction spaces in which may be accelerated the charged particles coming from a source of particles disposed substantially at the center of the enclosure; means for injecting into the resonant system a microwave signal for creating in the interaction spaces an accelerating microwave field; the resonant system comprising furthermore a resonant element constituted with an external conductor formed from a cylindrical tube closed at one of its ends and opening at the other end into the enclosure to which it is fixed and, placed in this external conductor, an internal conductor having the form of a loop whose end is fixed to the "Dee", this loop determining with the external conductor an adjustable capacity C enables the ratio $f_1/f_2$ of the operating frequencies $f_1$ and $f_2$ of said resonant system to be adjusted, the magnetic induction required for operation of said cyclotron at said frequencies $f_1$ and $f_2$ being substantially inchanged.

The above and other objects, features and advantages of the present invention will be become apparent from the following description, given solely by way of non-limiting illustration, when taken in conjunction with the accompanying drawings.

DESCRIPTION OF THE DRAWINGS

FIG. 4 shows a resonant system for a cyclotron, in accordance with the invention.

FIG. 5 shows the equivalent electrical diagram of the resonant system shown in FIG. 4.

FIG. 6 shows the values of the resonant frequencies obtained in the embodiment of the resonant system shown in FIG. 4.

FIGS. 17 and 18 show respectively two embodiments of microwave coupling of the microwave source and of the resonant system in accordance with the invention.

DESCRIPTION OF THE PREFERRED EMBODIMENTS

Figure 1:
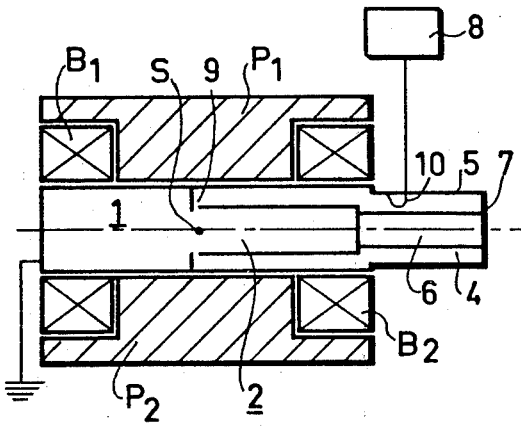
FIGS. 1 and 2 show respectively, in longitudinal section and in cross-section, a coaxial line resonant system of a known type.
Figure 2:
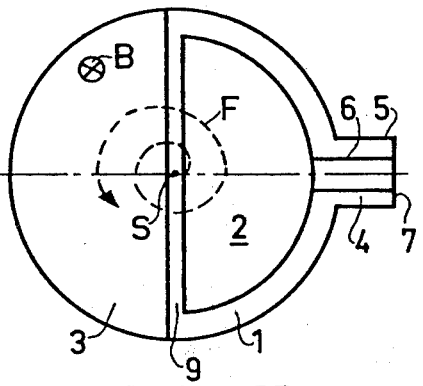
PRIOR ART FIG. 2
Figure 3:
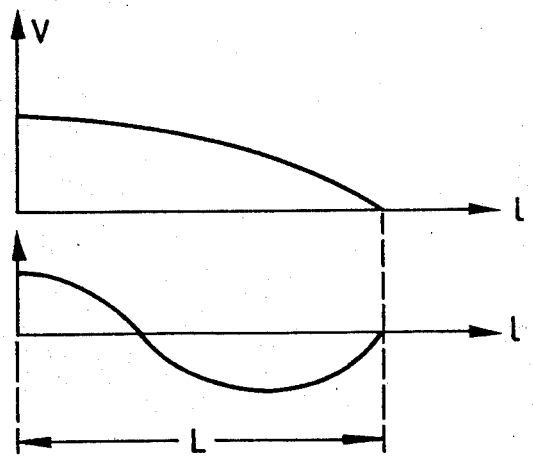
PRIOR ART FIG. 3
FIG. 3 shows the electrical field distribution along this coaxial line for two operating frequencies.

FIGS. 1 and 2 show schematically, in longitudinal and cross-section, a resonant system used in some conventional cyclotrons, this resonant system comprising a metal enclosure 1 in which is disposed, without electrical contact, a metal electrode 2, or "Dee" in the form of a semicircular box, a coaxial resonant element 4 whose external conductor 5 is fixed to enclosure 1 and whose central conductor 6 is fixed to the "Dee" 2, this resonant element being short-circuited at its end by a plate 7.

The semi-circular electrode 2 or "Dee" opens into enclosure 1 by its flat face so as to leave a passageway for the beam. In operation, a source S of charged particles emits a beam F of particles which, under the action of a magnetic field B, describes a spiral, the particles of this beam being periodically accelerated by means of an HF electric field created in the interaction space 9 by the HF signal injected into enclosure 1 by means of a microwave coupling system, a coupling loop 10 for example.

However, it should be noted that a cyclotron provided with a resonant system such as shown in FIG. 1 and having to operate successively with two particles of different types (protons and deutons for example) with the magnetic induction B remaining constant, the frequency of the accelerating microwave electric field, if it is desired to obtain maximum efficiency of the cyclotron for these two particles, should be in a ratio of 1 to 2. Now, the resonant system shown in FIG. 1 and comprising a semi-circular "Dee" excludes any operation with even harmonics for, in order that the particles find an accelerating HF electric field during their second passage through interaction space 9, the travel time thereof must be equal to an uneven number of half-periods of the microwave accelerating field. If then, a microwave electric field of frequency $f_p$ is used for the protons, a microwave electric field of frequency $f_d=3f_p$ must be used for the deutons. In this case, it will be necessary to reduce the value of magnetic induction B when the cyclotron operates with deutons, this resulting in a reduction of the energy of these deutons at the output of the cyclotron.

The cyclotron having a resonant system in accordance with the present invention may operate at two frequencies whose ratio, close to 2, is adjustable during manufacture or variable in operation according to the type of particles used. This resonant system, shown in FIG. 4, comprises a metal enclosure 11 in which is disposed, without contact, a metal electrode 12 or "Dee" in the form of a semi-circular box, a resonant element 14 having a cylindrical external conductor 15 which is fixed to the lateral face of the metal enclosure 11 and two internal conductors 16 and 17 parallel to the generatrices of the external conductor 15 and connected together by means of a connecting element 18. Conductor 17 is fixed "Dee" 12 whereas conductor 16 is fixed to the enclosure 11 connected to ground. Resonant element 14 is closed at its end by a metal plate 19 without contact with the internal conductors 16 and 17 and the connecting element 18.

The resonant system of the invention, such as shown in FIG. 4, has an equivalent electric diagram shown in FIG. 5.

Let $C_D$ be the capacity formed by "Dee" 12 and enclosure 11, let C be the capacity formed by connecting element 18 and plate 19, let $C_{12}$ and $C_{21}$ be the capacities shared between the two internal conductors 16, 17 and, finally, let $C_{11}$ and $C_{22}$ be the capacities shared respectively between the two internal conductors 16, 17 on the one hand, and the external conductor 15 on the other hand, of resonant element 14. If we assume that $C_1=C_{11}+C_{12}$, $C_2=C_{22}+C_{21}$, the propagation equations and the conditions at the limits permit the following relationship to be written down:

$$\left[C_1^2+\frac{\omega 2}{c^2}C\cdot C_D\right]tg^2\frac{\omega}{c}L-$$

$$[C_D(C_1+C_2)-C\cdot C_{11}]\frac{\omega}{c}\,tg\frac{\omega}{c}L+C_1\cdot C_{12}-C_2\cdot C_{11}=0$$

where c is the speed of light and $\omega=2\pi f$ the pulsation at resonance. If we assume that external conductor 15 and internal conductors 16 and 17 are circular sections and have respective radii R and r, and that the internal conductors 16 and 17 have a distance between axes equal to 2a, and if we assume that:

$$\alpha=\mathrm{Log}\left[\frac{1}{r}\left(\frac{R^2}{a}-a+r\right)\right] \tag{2}$$

$$\beta=\mathrm{Log}\left[\frac{1}{2a-r}\left(\frac{R^2}{a}-a+r\right)\right] \tag{3}$$

we may write:

$$C_{11}=C_{22}=1/(\alpha+\beta) \tag{4}$$

$$C_{12}=C_{21}=1/(\alpha^2-\beta^2) \tag{5}$$

The curves shown in FIG. 6 are obtained from equation 1. For one embodiment where R=15 cm, r=2.5 cm, a=5 cm and $C_D$=125 pF, it may be verified that the ratio of the resonant frequencies $f_1$ and $f_2$ obtained is of the order of 2 if capacity C is close to $C_D$.

Figure 7:
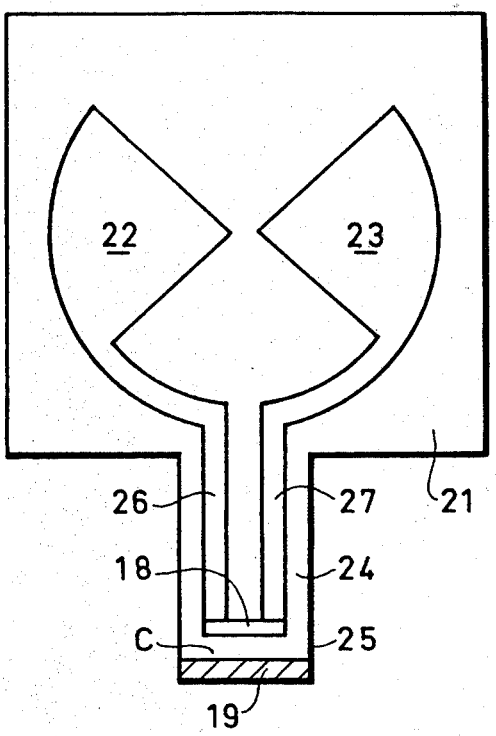
FIG. 7 shows another embodiment of a resonant system in accordance with the invention.

FIG. 7 shows another embodiment of a resonant system in accordance with the invention.

This resonant system comprises an enclosure 21 in which are disposed, facing each other, two "Dees" 22 and 23 in the shape of sectors, without contact with enclosure 21, a resonant element 24 comprising a cylindrical external conductor 25 and two internal conductors 26 and 27 parallel to the generatrices of the external conductor 25, these internal conductors 26 and 27 being connected, on the one hand, one to the other by a connecting element 18 and, on the other hand, to the "Dees" 22 and 23 respectively.

The choice of the value of capacity C determined by connecting element 18 and plate 19 closing resonant element 24 allows the resonant frequencies $f_1$ and $f_2$ of the resonant system of the invention and the ratio $m=f_1/f_2$ of these frequencies $f_1$ and $f_2$ to be adjusted.

Figure 10:
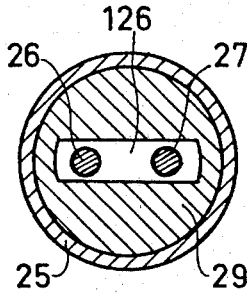
FIGS. 8 to 13 show details of construction of a resonant system in accordance with the invention.
Figure 8:
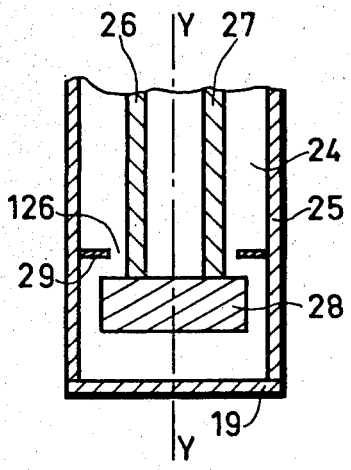
Figure 9:
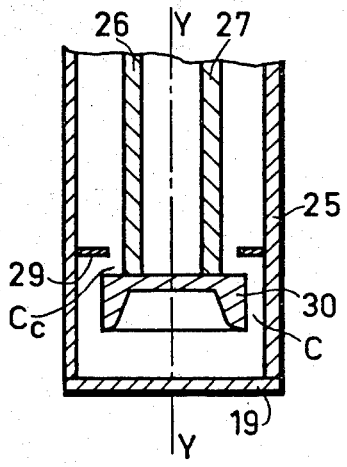

FIG. 8 shows another embodiment of the resonant element and more particularly of the connecting element for the internal conductors 26 and 27 determining the capacity C of the resonant system. So as to facilitate adjustment of the resonant frequencies ratio $f_1/f_2$ of the resonant system of the invention, it is advantageous to use a connecting element allowing a value of capacity C to be obtained which is substantially insensitive to the thermal expansion of the resonant element, in particular to the elongation of the internal conductors 26 and 27 of this resonant element 24. It is then advantageous to use a connecting element formed, as shown in FIG. 8, by a cylinder 28 joining the internal conductors 26 and 27 of the resonant element, this cylinder 28 being disposed coaxially to the external conductor 25 of resonant element 24, rather than a flat capacitor such as the one shown in FIG. 7 and formed by bar 18 and plate 19 for closing the resonant element 24. So as to reduce the capacity obtained between connecting element 28 and plate 19 for closing the resonant element 24, this connecting element 28 may be replaced by a connecting element 30 of re-entrant form, such as shown in FIG. 9, so as to reduce appreciably the value of the capacity determined by this connecting element and closure plate 19. It should be noticed that the elongation of resonant element 24 under the effect of an increase in temperature results in a decrease of the resonant frequency of the resonant system. To compensate for this frequency variation, there may be disposed in resonant element 24 (FIGS. 8, 9, 10) a circular plate 29 provided with an oval aperture 126, for passing therethrough internal conductors 26 and 27, this circular plate 29 forming with connecting element 30 a complementary variable capacity $C_C$ compensating for the variation of capacity C.

Figure 11:
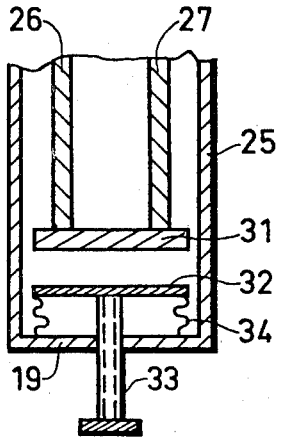

So as to be able to adjust more readily the resonant frequencies ratio $f_1/f_2$ of the resonant system in accordance with the invention by varying capacity C, there may be disposed, inside resonant element 24 (FIG. 11), between connecting element 31 and end-plate 19, a mobile plate 32. This plate 32 may be fitted with a threaded rod 33 which is perpendicular thereto at its center (as shown in FIG. 11) and which passes through end-plate 19. A flexible membrane 34 ensures the vacuum seal of the resonant system.

Figure 12:
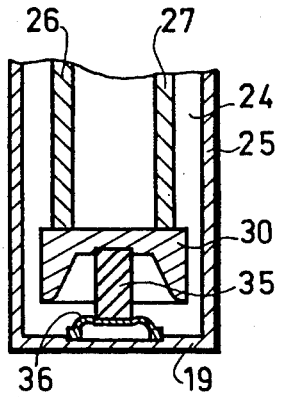

These different embodiments are given by way of non-limiting examples. There may in particular be disposed in resonant element 24 a centering stud 35 for centering the assembly formed by internal conductors 26 and 27 and connecting element 30 (FIG. 12). This stud 35 is fixed to cylinder 30 on the one hand and to a flexible membrane 36 on the other hand, this membrane 36 being integral with plate 19 closing resonant element 24.

Figure 13:
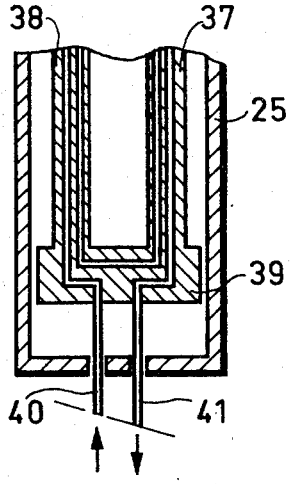

Another detail of construction is shown in FIG. 13. Cooling tubes 40, 41, in which may flow a cooling fluid, pass through the internal conductors 37, 38 and connecting element 39.

Figure 14:
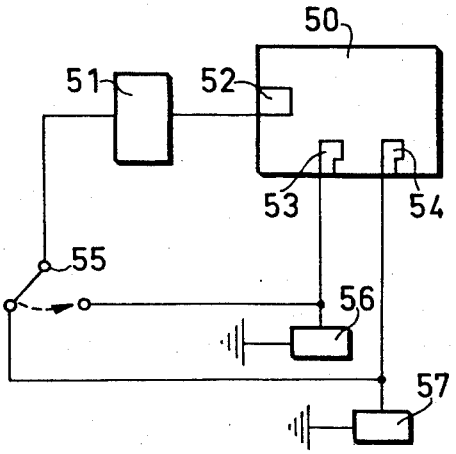
FIGS. 14 to 16 show respectively an example of microwave energization by means of an oscillator looped on the resonant system of the invention and the magnetic field distribution in the resonant element of this system for two frequencies $f_1$ and $f_2$.
Figure 15:
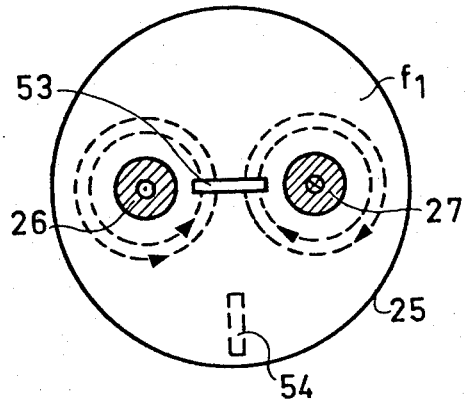
Figure 16:
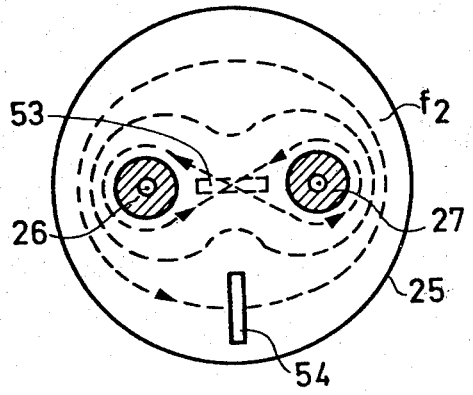

The resonant system of the invention may be energized either by an external driving oscillator, the excitation of one or the other frequency $f_1$ and $f_2$ then taking place without ambiguity because of the considerable separation of the two operating frequencies $f_1$, $f_2$. An oscillator 51 may also be used looped to the resonant system itself, this resonant system being able to be associated with two selective loops, as shown in FIG. 14. An oscillator 51 is coupled to the resonant system 50 of the invention by means of a coupling system which may be magnetic (loop 53) or capacitive. A selection inverter 55 allows either loop 53, or loop 54 to be selected, according as to whether it is desired to use frequency $f_1$ or frequency $f_2$. It should be noted that the presence of the unused loop does not disturb the operation of the resonant system since, in principle, it is in a fieldless zone. In fact, one of the selective loops 53 is placed between the internal conductors 26, 27 of the resonant element, in the plane which contains the axes of these conductors 26, 27, so as to be able to take the magnetic field from the microwave signal when the resonant system resonates at frequency $f_1$ (FIG. 15), whereas the other selective loop 54 corresponding to frequency $f_2$ is disposed in the vicinity of the external conductor 25 of the resonant element (FIG. 16) and is placed in the plane of symmetry of the two internal conductors 26 and 27, this plane of symmetry being perpendicular to the plane which contains the axes of these internal conductors 26, 27.

FIGS. 17 and 18 show respectively constructional details of magnetic and capacitive couplings by means of a loop 52 (FIG. 17) or a capacitive element 54 (FIG. 18). In the examples shown in FIGS. 17 and 18, the sealing of the enclosures 11 and 12 of the resonant system of the invention is provided by means of a seal 58 made from an electrically insulating material.

It is apparent that within the scope of the invention, modifications and different arrangements can be made other than are here disclosed. The present disclosure is merely illustrative with the invention comprehending all variations thereof.

What is claimed is:

1. A resonant system for a cyclotron intended to operate at least at two frequencies $f_1$, $f_2$ and to accelerate successively charged particles of different types, this resonant system comprising an enclosure connected to ground and at least one hollow electrode or sector-shaped "Dee" inside which the beam of particles to be accelerated may travel, said electrode being disposed in the enclosure without electrical contact with said enclosure, said enclosure being placed between pole pieces of an electromagnet for supplying a magnetic field required for operation of the cyclotron; the electrode or "Dee" delimiting with the enclosure interaction spaces in which may be accelerated the charged particles issued from a source of particles disposed substantially in the center of the enclosure; means for injecting into the resonant system microwave signals for creating in the interaction spaces an accelerating microwave field; a resonant element provided with an external conductor formed from a cylindrical tube closed at one of its ends and opening at the other end into the enclosure to which it is fixed and, placed in said external conductor, an internal conductor having one end fixed to the "Dee", wherein said internal conductor has the form of a loop said loop determining with the external conductor an adjustable capacity C enables the ratio $f_1/f_2$ of the operating frequencies $f_1$, $f_2$ to be adjusted, the magnetic field required for operation of said cyclotron at frequencies $f_1$, $f_2$ being substantially unchanged.

2. The resonant system as claimed in claim 1, wherein the loop is formed from two metal internal conductors parallel to the generatrix of the cylindrical external conductor, said internal conductors, one at least of which is fixed to the "Dee" being connected to one another, at their other end, by a metal connecting element determining with the external conductor the capacity C of given value.

3. The resonant system as claimed in claim 2, and comprising two electrodes or sector-shaped "Dees" placed in the enclosure, the internal conductors of the resonant element being fixed respectively to one end and the other of these "Dees".

4. A resonant system for a cyclotron intended to operate at least at two frequencies $f_1$, $f_2$ and to accelerate successively charged particles of different types, this resonant system comprising an enclosure connected to ground and at least one hollow electrode or sector-shaped "Dee" inside which the beam of particles to be accelerated may travel, said electrode being disposed in the enclosure without electrical contact with said enclosure, said enclosure being placed between pole pieces of an electromagnet for supplying a magnetic field required for operation of the cyclotron; the electrode or "Dee" delimiting with the enclosure interaction spaces in which may be accelerated the charged particles issued from a source of particles disposed substantially in the center of the enclosure; means for injecting into the resonant system microwave signals for creating in the interaction spaces an accelerating microwave field; the resonant system comprising furthermore a resonant element provided with an external conductor formed from a cylindrical tube closed at one of its ends and opening at the other end into the enclosure to which it is fixed and, placed in said external conductor, an internal conductor having the form of a loop one end of which is fixed to the "Dee", said loop determining with the external conductor an adjustable capacity C enables the ratio $f_1/f_2$ of the operating frequencies $f_1,f_2$ to be adjusted, the magnetic field required for operation of said cyclotron at frequencies $f_1,f_2$ being substantially unchanged, wherein said loop is formed from two metal internal conductors parallel to the generatrix of said cylindrical external conductor, said internal conductors, one at least of which is fixed to the "Dee", being connected to one another, at their other end, by a metal connecting element determining with the external conductor the capacity C of given value wherein a circular plate provided with a central aperture for passing the internal conductors therethrough, is disposed above the connecting element, said plate determining with said connecting element a variable capacity depending on the longitudinal movement of said connecting element.

5. A resonant system for a cyclotron intended to operate at least at two frequencies $f_1$, $f_2$ and to accelerate successively charged particles of different types, this resonant system comprising an enclosure connected to ground and at least one hollow electrode or sector-shaped "Dee" inside which the beam of particles to be accelerated may travel, said electrode being disposed in the enclosure without electrical contact with said enclosure, said enclosure being placed between pole pieces of an electromagnet for supplying a magnetic field required for operation of the cyclotron; the electrode or "Dee" delimiting with the enclosure interaction spaces in which may be accelerated the charged particles issued from a source of particles disposed substantially in the center of the enclosure; means for injecting into the resonant system microwave signals for creating in the interaction spaces an accelerating microwave field; the resonant system comprising furthermore a resonant element provided with an external conductor formed from a cylindrical tube closed at one of its ends and opening at the other end into the enclosure to which it is fixed and, placed in said external conductor, an internal conductor having the form of a loop one end of which is fixed to the "Dee", said loop determining with the external conductor an adjustable capacity C enables the ratio $f_1/f_2$ of the operating frequencies $f_1,f_2$ to be adjusted, the magnetic field required for operation of said cyclotron at frequencies $f_1,f_2$ being substantially unchanged, wherein said loop is formed from two metal internal conductors parallel to the generatrix of said cylindrical external conductor, said internal conductors, one at least of which is fixed to the "Dee", being connected to one another, at their other end, by a metal connecting element determining with the external conductor the capacity C of given value wherein the connecting element is a cylindrical element coaxial to the external conductor of the resonant element, the height of the lateral walls of this connecting element and its diameter determining the value of the capacity formed by the lateral wall of the connecting element and the external conductor of the resonant element.

6. A resonant system for a cyclotron intended to operate at least at two frequencies $f_1$, $f_2$ and to accelerate successively charged particles of different types, this resonant system comprising an enclosure connected to ground and at least one hollow electrode or sector-shaped "Dee" inside which the beam of particles to be accelerated may travel, said electrode being disposed in the enclosure without electrical contact with said enclosure, said enclosure being placed between pole pieces of an electromagnet for supplying a magnetic field required for operation of the cyclotron; the electrode or "Dee" delimiting with the enclosure interaction spaces in which may be accelerated the charged particles issued from a source of particles disposed substantially in the center of the enclosure; means for injecting into the resonant system microwave signals for creating in the interaction spaces an accelerating microwave field; the resonant system comprising furthermore a resonant element provided with an external conductor formed from a cylindrical tube closed at one of its ends and opening at the other end into the enclosure to which it is fixed and, placed in said external conductor, an internal conductor having the form of a loop one end of which is fixed to the "Dee", said loop determining with the external conductor an adjustable capacity C enables the ratio $f_1/f_2$ of the operating frequencies $f_1,f_2$ to be adjusted, the magnetic field required for operation of said cyclotron at frequencies $f_1,f_2$ being substantially unchanged, wherein said loop is formed from two metal internal conductors parallel to the generatrix of said cylindrical external conductor, said internal conductors, one at least of which is fixed to the "Dee", being connected to one another, at their other end, by a metal connecting element determining with the external conductor the capacity C of given value and wherein the connecting element is a cylindrical-shaped element whose lower face has a re-entrant profile, said cylindrical element being coaxial with the external conductor of the resonant element.

7. The resonant system as claimed in claim 2, wherein said internal conductor of said resonant element are connected at one of their ends by a connecting element in the form of a circular plate, and a mobile plate parallel to the circular plate enables the capacity formed by said circular plate and said mobile plate to be varied.

8. A resonant system for a cyclotron intended to operate at least at two frequencies $f_1$, $f_2$ and to accelerate successively charged particles of different types, this resonant system comprising an enclosure connected to ground and at least one hollow electrode or sector-shaped "Dee" inside which the beam of particles to be accelerated may travel, said electrode being disposed in the enclosure without electrical contact with said enclosure, said enclosure being placed between pole pieces of an electromagnet for supplying a magnetic field required for operation of the cyclotron; the electrode or "Dee" delimiting with the enclosure interaction spaces in which may be accelerated the charged particles issued from a source of particles disposed substantially in the center of the enclosure; means for injecting into the resonant system microwave signals for creating in the interaction spaces an accelerating microwave field; the resonant system comprising furthermore a resonant element provided with an external conductor formed from a cylindrical tube closed at one of its ends and opening at the other end into the enclosure to which it is fixed and, placed in said external conductor, an internal conductor having the form of a loop one end of which is fixed to the "Dee", said loop determining with the external conductor an adjustable capacity C enables the ratio $f_1/f_2$ of the operating frequencies $f_1,f_2$ to be adjusted, the magnetic field required for operation of said cyclotron at frequencies $f_1,f_2$ being substantially unchanged, wherein said loop is formed from two metal internal conductors parallel to the generatrix of said cylindrical external conductor, said internal conductors, one at least of which is fixed to the "Dee", being connected to one another, at their other end, by a metal connecting element determining with the external conductor the capacity C of given value wherein the connecting element is centered in the resonant element by means of a centering stud fixed to a flexible membrane, said flexible membrane which ensures the seal of the resonant system being integral with the end closure plate of the resonant element.

9. The resonant system as claimed in claim 2, wherein tubular elements in which a cooling fluid may flow are placed inside the internal conductors of the resonant element and in the connecting element of these internal conductors.

10. The resonant system as claimed in claim 2, wherein the means for creating a microwave accelerating electric field in the interaction space of the cyclotron comprises a microwave generator of the oscillator type electromagnetically coupled to the resonant system, a coupling system allowing the microwave signal to be injected into the system, two selective coupling loops enabling the resonant system to operate at the selected one of frequencies $f_1$ or $f_2$.

11. The resonant system as claimed in claim 10, wherein one of the selective loops is placed between the internal conductors of the resonant element, in the plane which contains the axes of these conductors, so as to take the magnetic field from the microwave signal when the system resonates at frequency $f_1$, the other selective loop being disposed in the vicinity of the external conductor of the resonant element and being placed in the plane of symmetry of the two internal conductors of said resonant element, this plane of symmetry being perpendicular to the plane which contains the axes of said internal conductor, the selection of the frequencies $f_1$ and $f_2$ by means of said loops being provided by means of a switching system.

* * * * *